US007320489B1

(12) United States Patent
Domb

(10) Patent No.: US 7,320,489 B1
(45) Date of Patent: Jan. 22, 2008

(54) GOLF DISC RETRIEVER AND METHOD

(75) Inventor: Simon Roy Domb, 604 Devonshire St., Oldsmar, FL (US) 34677

(73) Assignee: Simon Roy Domb, Oldsmar, FL (US)

( * ) Notice: Subject to any disclaimer, the term of this patent is extended or adjusted under 35 U.S.C. 154(b) by 0 days.

(21) Appl. No.: 11/422,072

(22) Filed: Jun. 3, 2006

(51) Int. Cl.
*B25J 1/00* (2006.01)

(52) U.S. Cl. ..... 294/19.1; 294/104

(58) Field of Classification Search ..... 294/19.1, 294/19.2, 24, 26, 66.1, 66.2, 104
See application file for complete search history.

(56) References Cited

U.S. PATENT DOCUMENTS 1,638,184 A * 8/1927 Curtis ..... 294/19.1
1,715,039 A * 5/1929 Locke et al. ..... 294/99.1
3,046,044 A * 7/1962 Christle ..... 294/19.2
4,073,529 A * 2/1978 Ostrin ..... 294/19.2
4,248,465 A * 2/1981 Halstead ..... 81/484
4,751,892 A * 6/1988 Sechel et al. ..... 114/221 R
5,184,859 A * 2/1993 Nihra et al. ..... 294/19.2
5,823,590 A * 10/1998 Forrest et al. ..... 294/19.1
5,941,586 A * 8/1999 Fann ..... 294/19.1
6,705,654 B2 * 3/2004 Slauf ..... 294/24
6,726,265 B2 * 4/2004 Miller ..... 294/66.1

* cited by examiner

*Primary Examiner*—Dean J Kramer

(57) ABSTRACT

The present invention relates to a golf disc retriever attached to an elongating handle having a substantially U-shaped rigid frame with space between adjacent upper and lower legs of the U-shaped frame to allow the passage of the rimmed edge of a golf disc into the confines thereof and to be captured, by its rimmed edge, with a movable upward acting, spring actuated rigid plate member attached to the lower leg by a integral hinge, so as to retrieve golf discs from relatively inaccessible places which include water hazards, tree hazards and the like.

6 Claims, 2 Drawing Sheets

GOLF DISC RETRIEVER AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to sports objects and in particular to a golf disc retriever and method for retrieving golf discs in the sport of disc golf.

2. Description of the Prior Art

In recent years, the sport of Disc Golf has been gaining popularity and more and more courses are being set up to offer this alternative to traditional golf. Similar obstacles exist on a disc golf course as on a traditional golf course. The primary obstacle is the water hazard. Many golf balls end up in water hazards out of arms reach and likewise so do golf discs. However, a golf disc's price is many more times that of a golf ball and so the increased desire to retrieve it. Golf discs are not disposable and a device and method to retrieve them from inaccessible places such as water hazards and the like is needed. There have been many attempts to provide golf ball retrievers, however; currently, few devices exist to address the issue of retrieving a golf disc.

U.S. Pat. No. 6,705,654, Issued Mar. 16, 2004 to Slauf, indicates a golf disc retriever consisting of an extension pole with a nail head or disc shaped hook for retrieving golf discs from water hazards, trees and the like. However, this example of prior art does not positively capture a golf disc by its edge during retrieval, as does the present invention, but rather relies only on gravity and extreme care of the user not to disengage the golf disc during its basic hooking action method of golf disc retrieval.

U.S. Pat. No. 6,726,265, Issued Apr. 27, 2004 to Miller, indicates a golf disc retriever with a rectangular frame, triangulated wire leads and pull line for capturing and retrieving golf discs primarily from water hazards by a dredging action. However, this example of prior art does not positively capture a golf disc during retrieval either, but rather relies on the disc wedging itself against the inside of the rectangular frame during its dredging action method of retrieval. Additionally, this example of prior art was not intended to retrieve golf discs from hazards such as trees for risk of entanglement of the device and its pull line. No part of the present invention promotes entanglement in a tree hazard.

SUMMARY OF THE INVENTION

An object of the present invention is to provide a golf disc retriever that will positively capture a golf disc during the process of retrieval from a disc golf course obstacle such as a water hazard or the like. Another object of the present invention is to provide a golf disc retriever with an elongating handle, a fixed frame, a frame to handle mounting, a movable plate member, a hinge and a spring. A further object of the present invention is that the fixed frame is attached to the handle by a mounting. Another object of the present invention is that the movable plate member is attached to the frame by a hinge. Yet another object of the present invention is that the spring is attached at the hinge and acts between the fixed frame and the movable plate member. An additional object of the present invention is the method of retrieving a golf disc which consists of the following three steps: approach positioning of the golf disc retriever to a golf disc during retrieval; engagement positioning of the golf disc retriever to a golf disc during retrieval; and capture positioning of the golf disc retriever to a golf disc during retrieval. A golf disc is approached by positioning the golf disc probing edge of the present invention adjacent to the lower section of the rim of a golf disc ready for engagement of the golfing disc. A golf disc is engaged by advancing the golf disc probing edge past the lower section of the rim of the golf disc towards the golf disc's center and allowing the golf disc guiding surface to engage the top side of the golf disc, which in turn actuates the movable plate ready for the capture and retrieval of the golf disc. A golf disc is retrieved by further advancing along the actuated movable plate until the rim of the golf disc passes over the golf disc retaining edge on the distal end of the movable plate, which causes the movable plate to spring back to its non-actuated position and thus captures the golf disc by its rim, allowing the golf disc to be lifted out and away from said hazard and be retrieved.

BRIEF DESCRIPTION OF THE DRAWINGS

A fuller understanding of the nature and objects of the present invention will become apparent upon the consideration of the following detailed description, taken in connection with the accompanying drawings, wherein.

DETAILED DESCRIPTION OF THE INVENTION

Figure 1:
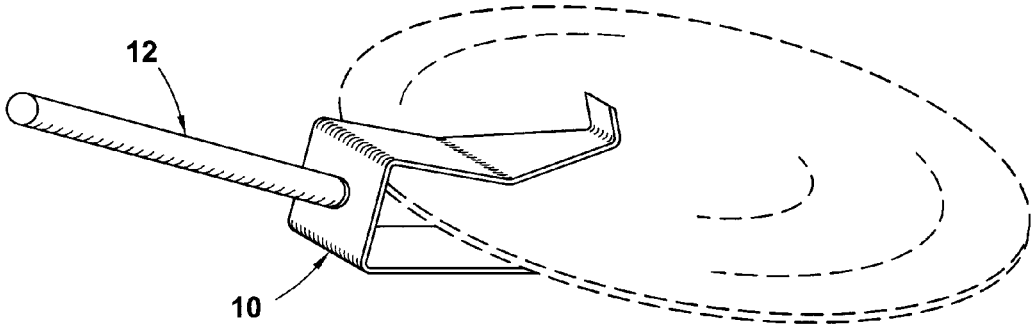
FIG. 1 is a perspective view of a golf disc retriever embodying the invention attached to an elongating handle and showing a captured golfing disc.

Referring now to the drawings, FIG. 1 illustrates a perspective view of preferred golf disc retriever 10 having a elongating handle 12 preferably of telescoping tubular aluminum sections that allow one to extend ones reach beyond arms length to retrieve a golf disc as shown in FIG. 1, yet is retractable for easy carrying or storage.

Figure 2:
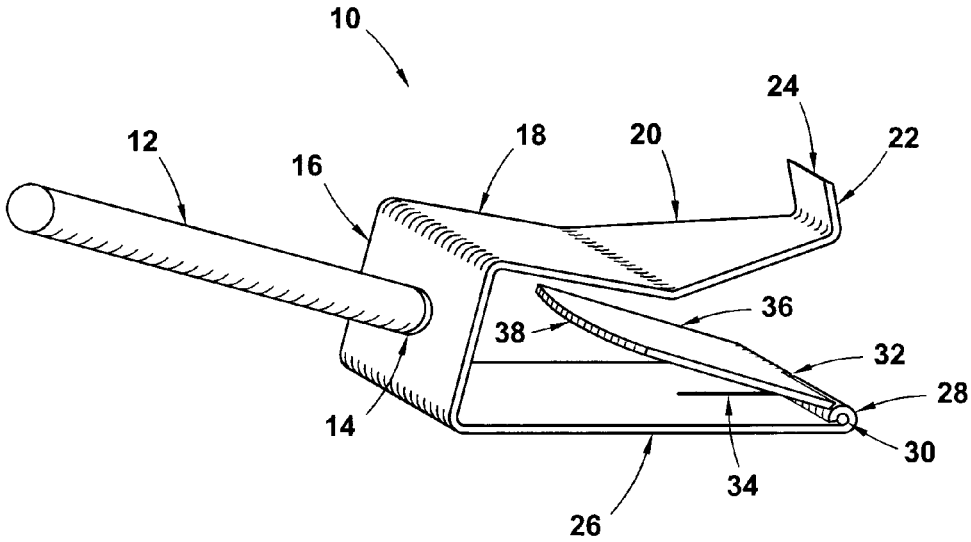
FIG. 2 is a perspective view of said golf disc retriever in FIG. 1 showing more detail.

At the distal end of elongating handle 12 golf disc retriever 10 is positioned, which is shown in more detail in FIG. 2. Referring now to FIG. 2, golf disc retriever 10 is made of a rigid material like metal or plastic, or a combination of both, and attached at angled mounting surface 16 to handle 12 by mounting 14, which may be a separate fastener like a rivet or an integral fastening section of golf disc retriever 10.

Golf disc retriever's 10 substantially U-shaped frame is the fixed embodiment of the invention and comprises angled mounting surface 16, which is beneficially angled to improve the position of hinged disc probing edge 28 during the action of disc retrieval, and supports an upper and lower leg of golf disc retriever's 10 substantially U-shaped frame.

Said upper leg comprises the following embodiments and is described in order from proximal end to distal end.

First, is an angled upper disc retaining surface 18, which is beneficially angled to improve retention of a disc during disc retrieval.

Figure 4:
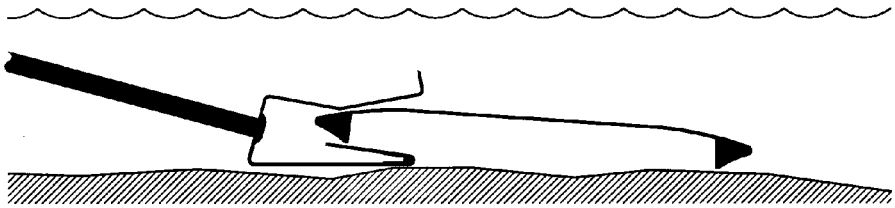
FIG. 4 is a section view of said golf disc retriever in FIGS. 1 and 2, which shows a golfing disc in the engagement position to said golf disc retriever; and, FIG. 5 is a section view of said golf disc retriever in FIGS. 1 and 2, which shows a golfing disc in the capture position to said golf disc retriever.

Second, is an angled disc guiding surface 20, which is beneficially angled to improve guidance of a disc into the confines of golf disc retriever's 10 substantially U-shaped frame during the engagement position of a disc retrieval as illustrated in FIG. 4. A further feature of angled disc guiding surface 20 is that angled disc guiding surface 20 narrows in width from proximal end to distal end to create an improved auxiliary disc hooking surface 22.

The final embodiment of said upper leg is an auxiliary disc hooking surface 22, which provides for an alternate and secondary method of disc retrieval by a simple hooking action, should the need arise during disc retrieval. However, is not as positive a retrieval method as the primary method being described here within and illustrated in FIG. 5 and therefore is designated alternate and secondary. Auxiliary disc hooking surface 22 is narrower in width than golf disc retriever's 10 substantially U-shaped frame to improve auxiliary disc hooking surface's 22 function as a hook for hooking golf discs. Another feature of auxiliary disc hooking surface 22 is disc-hooking edge 24. Disc hooking edge 24 is sharpened to provide disc hooking surface 22 with a more positive contact point with a disc during this alternate and secondary method of disc retrieval by way of the weight of the disc acting on a reduced contact surface being that of said sharpened edge during said simple hooking action.

Said lower leg comprises the following embodiments and is described in order from proximal end to distal end.

First, is a probing edge support surface 26, which is the majority of said lower leg and is the first of two leaves of an integral hinge, which is part of hinged probing edge 28.

Figure 3:
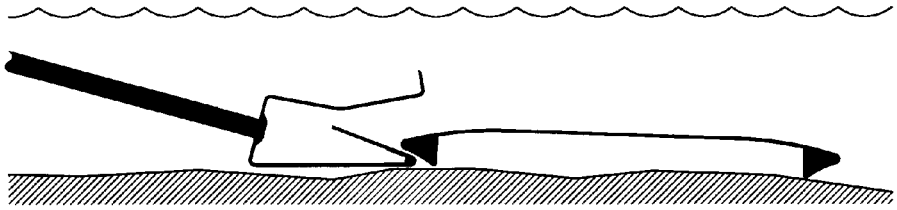
FIG. 3 is a section view of said golf disc retriever in FIGS. 1 and 2, which shows a golfing disc in the approach position to said golf disc retriever.
Figure 5:
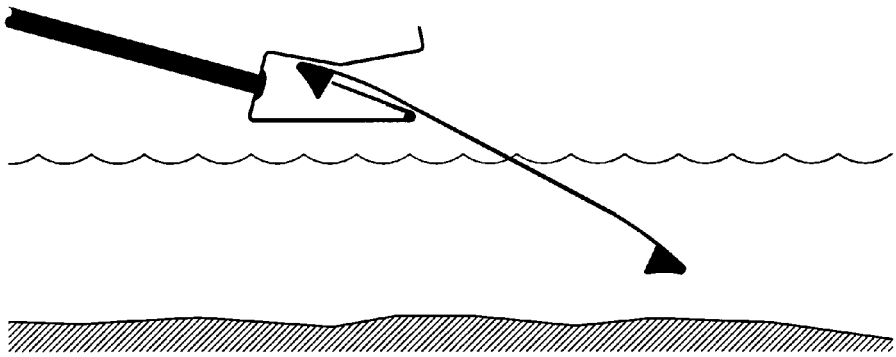

Second, is hinged probing edge 28 and is comprised of a small diameter butt type hinge with a removable hinge pin 30 that has a small gap in the knuckles of said hinge being torsion spring hinge gap 32, which accommodates torsion spring 34 and a disc-retaining plate 36. Hinged probing edge's 28 smaller proportion relative to a golf disc's tapered rim, improves hinged probing edge's 28 ability to probe under said tapered rim during the approach position of a disc retrieval as illustrated in FIG. 3. Torsion spring 34 is comprised of a very light gauge corrosion resistant metal so as to easily actuate when a golf disc is engaged during retrieval as illustrated in FIG. 4 and then deactivate when a disc is captured during retrieval as illustrated in FIG. 5. Torsion spring 34 is attached at said hinge, by hinge pin 30 passing through the coiled center of torsion spring 34 during said hinge assembly. Hinge pin 30 is removable, so as to aid in the future replacement of torsion spring 34.

The final embodiment of said lower leg is disc-retaining plate 36, which is the movable embodiment of the invention and comprises the second leaf of said integral hinge, which completes hinged probing edge 28. Disc-retaining plate 36 is movable about said hinge and is upward acting by the force exerted by torsion spring 34 acting against both the underside of disc-retaining plate 36 and topside of probing edge support surface 26. Disc-retaining plate 36 captures a golf disc by yielding under said disc's weight during the engagement position of a disc retrieval as illustrated in FIG. 4 and then springing back to trap said disc when said disc's rim has passed over disc-retaining plate 36, by way of said discs downward protruding rim as illustrated in FIG. 5. Disc retaining-plate 36 has an arcuate disc-retaining edge 38 at disc-retaining plate's 36 distal end to create clearance for the rim of a golf disc when approaching retrieval at angles that vary laterally from on axis with golf disc retriever 10. A golf disc is easily released from the golf disc retriever 10 after retrieval, by depressing disc-retaining plate 36 downward with a finger or thumb and then removing said disc.

What is claimed is:

1. A golf disc retriever comprising:

an elongating handle wherein said elongating handle is of rigid material and telescopic;

a U-shaped fixed frame made of rigid material;

a mounting to attach said elongating handle to said U-shaped fixed frame;

a movable plate member;

a hinge;

a spring;

said movable plate member attached to said U-shaped fixed frame by said hinge;

said spring attached at said hinge and acting between said U-shaped fixed frame and said movable plate member;

said U-shaped fixed frame having a mounting surface containing said mounting and supporting an upper leg and a lower leg;

said upper leg having an inward angled golf disc-retaining surface, an outward angled golf disc guiding surface and an outward angled golf disc hooking surface; and, said lower leg having a surface that supports a leaf of said hinge, which is also a first half of a golf disc probing edge.

2. The golf disc retriever as claimed in claim 1, wherein said hinge is a butt type hinge having first and second leaves that are part of said U-shaped fixed frame and said movable plate member respectively, and which together completes said golf disc probing edge which also has a removable hinge pin for replacement of said spring and a small gap in said hinge to accommodate said spring.

3. The golf disc retriever as claimed in claim 2, wherein said spring is a very light gauge torsion spring with coils, so as to be easily actuated by the action of a golf disc entering the confines of said U-shaped fixed frame and made of a corrosion resistant metal, and which is mounted into said small gap of said hinge by threading said removable hinge pin through the center of said spring's coils during assembly of said hinge.

4. The golf disc retriever as claimed in claim 3, wherein said movable plate member is of a rigid material that is movable by way of said hinge and upward acting by the force exerted by said spring against both said movable plate member and said U-shaped fixed frame and functioning to retain a golf disc and which further comprises a second leaf of said hinge which is also a second half of a golf disc probing edge at the proximal end of said movable plate member and has an arcuate golf disc-retaining edge at the distal end.

5. A method of retrieving a golf disc with a golf disc retriever device having an elongating handle, a U-shaped fixed frame having a mounting surface supporting an upper leg and a lower leg wherein the mounting surface has a mounting which attaches said U-shaped fixed frame to said elongating handle, a movable plate member having a golf disc-retaining edge on the distal end of said movable plate member, a hinge, and a spring, said movable plate member being attached to said U-shaped fixed frame's lower leg by said hinge, said spring being attached at said hinge and acting between said U-shaped fixed frame's lower leg and said movable plate member allowing said movable plate member to be actuated by being pressed by a golf disc towards the lower leg of said U-shaped fixed frame or non-actuated by being pressed by the spring away from the lower leg of said U-shaped fixed frame and creating a golf disc probing edge at said hinge comprising the steps of:

approach positioning of a golf disc retriever to a golf disc during retrieval wherein a golf disc is approached by positioning said golf disc probing edge of a golf disc retriever adjacent to a lower section of a rim of a golf disc ready for engagement of the golf disc.

engagement positioning of a golf disc retriever to a golf disc during retrieval wherein a golf disc is engaged by advancing said golf disc probing edge past a lower section of a rim of a golf disc towards the golf disc's center and allowing a surface of the upper leg of the golf disc U-shaped fixed frame to engage the top side of the golf disc, which in turn actuates said movable plate ready for the capture and retrieval of the golf disc.

capture positioning of a golf disc retriever to a golf disc during retrieval; and retrieving the golf disc with the golf disc retriever.

6. A method as claimed in claim 5, wherein a golf disc is retrieved by further advancing along said movable plate member in the actuated position until the rim of said golf disc passes over said golf disc-retaining edge on the distal end of said movable plate member, which causes said movable plate member to spring back to its non-actuated position and thus captures the golf disc by its rim, allowing the golf disc to be lifted out and away from a hazard and be retrieved.

* * * * *